United States Patent [19]

Swinea, Jr.

[11] 4,286,195

[45] Aug. 25, 1981

[54] DIMMER CIRCUIT FOR FLUORESCENT LAMPS

[75] Inventor: Jessie D. Swinea, Jr., Royal Oak, Mich.

[73] Assignee: Vultron, Inc., Waterford, Mich.

[21] Appl. No.: 54,778

[22] Filed: Jul. 5, 1979

[51] Int. Cl.[3] ..... H05B 37/02; H05B 39/04; H05B 41/36

[52] U.S. Cl. ..... 315/224; 315/DIG. 4; 315/DIG. 5; 315/291; 315/297

[58] Field of Search ..... 315/DIG. 2, DIG. 4, 315/DIG. 5, DIG. 7, 308, 307, 224, 291, 297; 331/113 A

[56] References Cited

U.S. PATENT DOCUMENTS

| | | | |
|---|---|---|---|
| 3,611,024 | 10/1971 | Nakatsu et al. | 315/DIG. 4 |
| 3,774,074 | 11/1973 | Souvay | 315/DIG. 5 |
| 3,927,349 | 12/1975 | Suhren et al. | 315/DIG. 4 |
| 3,935,502 | 1/1976 | Herzog | 315/DIG. 5 |
| 3,936,696 | 2/1976 | Gray | 315/DIG. 5 |
| 3,969,652 | 7/1976 | Herzog | 315/DIG. 7 |
| 4,170,747 | 10/1979 | Holmes | 315/DIG. 7 |
| 4,207,498 | 6/1980 | Spira et al. | 315/DIG. 4 |

*Primary Examiner*—Saxfield Chatmon, Jr.
*Attorney, Agent, or Firm*—Reising, Ethington, Barnard, Perry & Brooks

[57] ABSTRACT

A fluorescent lamp dimming circuit is disclosed for DC fluorescent lighting circuits of the type using a battery voltage source and an inverter. The dimming circuit comprises an electronic switch (24) connected between the battery (18) and the inverter (16) and an oscillator (26) is provided to periodically actuate the electronic switch to reduce the on-time of the lamp current. A timer (30) is connected with the oscillator (26) to disable the dimming circuit for a preset time interval after the lamp has been turned on by an on/off switch (20). Thus, the lamp is started at full intensity upon each start-up and after the time delay the dimmer circuit is effective to reduce the intensity.

7 Claims, 4 Drawing Figures

DIMMER CIRCUIT FOR FLUORESCENT LAMPS

TECHNICAL FIELD

This invention relates to fluorescent lighting systems and more particularly to a dimmer circuit for fluorescent lamps.

BACKGROUND ART

The conventional fluorescent lamp, namely a low pressure mercury vapor fluorescent electric discharge lamp, offers many advantages as a light source including high efficiency and good light distribution. However, control of the fluorescent lamp presents certain problems. Since it is a gas discharge device, a high starting voltage is required to initiate ionization and current limiting must be provided to avoid damage or destruction after ionization has taken place. Generally, the lamps are provided with a pair of heated electrodes to promote rapid starting, a transformer to provide high starting voltage, and a ballast is provided for current limiting.

There are several applications of fluorescent lighting in which dimming control, i.e. the reduction of light intensity from its normal running value, would be desirable. One present need for dimming control for fluorescent lamps arises especially in connection with fluorescent lighting systems on buses. In particular, certain present day intra-city buses provide a high level of illumination in the passenger areas and, under certain ambient lighting conditions, the internal bus lighting produces reflections on the windshield which makes it difficult for the driver to see out. Fluorescent lighting systems for buses are energized from a DC voltage source through an electronic inverter which supplies a pulsating DC output at relatively high voltage. It is desired to provide a light dimming device which will permit the bus driver to reduce the light intensity from the fluorescent lamps as needed by means of a simple manual control. There have been several attempts in the prior art to provide dimming devices for fluorescent lamps.

In AC fluorescent lighting systems, lamp dimming devices have been proposed which control the current conduction interval, or angle, for each half cycle of the supply voltage. A dimming system of this type using thyristors or silicon controlled rectifiers is described in U.S. Pat. No. 3,863,102 to Herzog and in U.S. Pat. No. 3,875,458 to Kappenhagen. A dimming system in which the current is switched on and off plural times for each half cycle by a gate controlled rectifier circuit is described in U.S. Pat. No. 3,422,309 to Spira et al. Another form of dimming circuit for AC fluorescent lighting circuits uses a saturable reactor in series with the ballast to adjust the voltage across the lamp. This type of dimmer is described in U.S. Pat. No. 3,264,518 to Stauverman.

In the typical DC fluorescent lamp circuit, an inverter is connected between the DC voltage source and the lamp. Inverters may be adapted to a wide range of DC source voltage, for example 5 to 50 volts, for producing a pulsating DC output voltage of sufficient amplitude to ionize the gas in a selected tube length of the fluorescent lamp. The inverters are typically operated at a frequency in the range from 10 kHz to 50 kHz. Usually, a ballast in the form of a series capacitor is connected between the inverter and the fluorescent lamp to limit the current flow through the ionized column of gas after the lamp is started. A transistor inverter circuit for fluorescent lamps using two transistors in push/pull configuration is described in U.S. Pat. No. 2,964,676 to Davies et al. Another transistor inverter for fluorescent lamps using a single transistor is described in U.S. Pat. No. 3,247,422 to Schultz.

Prior art dimming devices for DC fluorescent lamp circuits have obtained dimming by reducing the voltage across the lamp. In U.S. Pat. No. 3,119,048 to Tsuchiya, the fluorescent lamp is supplied by an inverter and dimming is obtained by reducing inverter output voltage by means of a variable feedback resistor. In U.S. Pat. No. 3,611,024 to Nakatsu et al., dimming is provided by reducing the lamp voltage by a variable resistor in series with the lamp discharge circuit or alternatively by control of the pulse amplitude from the pulse generator.

A general object of this invention is to provide an improved dimming means for controlling the brightness of a fluorescent lamp in a DC lighting circuit.

SUMMARY OF THE INVENTION

In accordance with this invention, the intensity of a fluorescent lamp is controlled by varying the lamp current while maintaining a substantially constant voltage across the lamp. This is accomplished by supplying to a lamp a train of voltage pulses having a substantially constant amplitude sufficient to start the lamp and run the lamp at a given intensity and reducing the on-time of the voltage pulses to reduce the intensity. This may be done by periodically interrupting the train of pulses for controlled time intervals. In one embodiment an inverter supplies the train of voltage pulses and the output of the inverter is periodically inhibited so that the average current to the lamp is reduced. Inhibiting means are provided in form of an electronic switch for disconnecting the DC voltage source from the inverter and the switch is actuated by an oscillator. Preferably, the pulse duration of the oscillator is greater and the frequency of the oscillator is lower than that of the inverter.

Further, according to the invention, dimming means is provided which may be manually set for bright or dim lighting and means are provided to insure that the lamp is always started at full current and high intensity even if the dimming means is set for reduced intensity. This is accomplished by timing means connected with between the power supply on/off switch and the inhibiting means so that it is disabled for a short time delay after the lamp is started.

Further, according to the invention, the dimming means can be manually overridden at any time. This is accomplished by a manually actuable bypass switch connected in shunt with the electronic switch whereby the inhibiting means may be rendered ineffective.

A more complete understanding of this invention may be obtained from the detailed description that follows taken with the accompanying drawings.

BEST MODE FOR CARRYING OUT THE INVENTION

Figure 1:
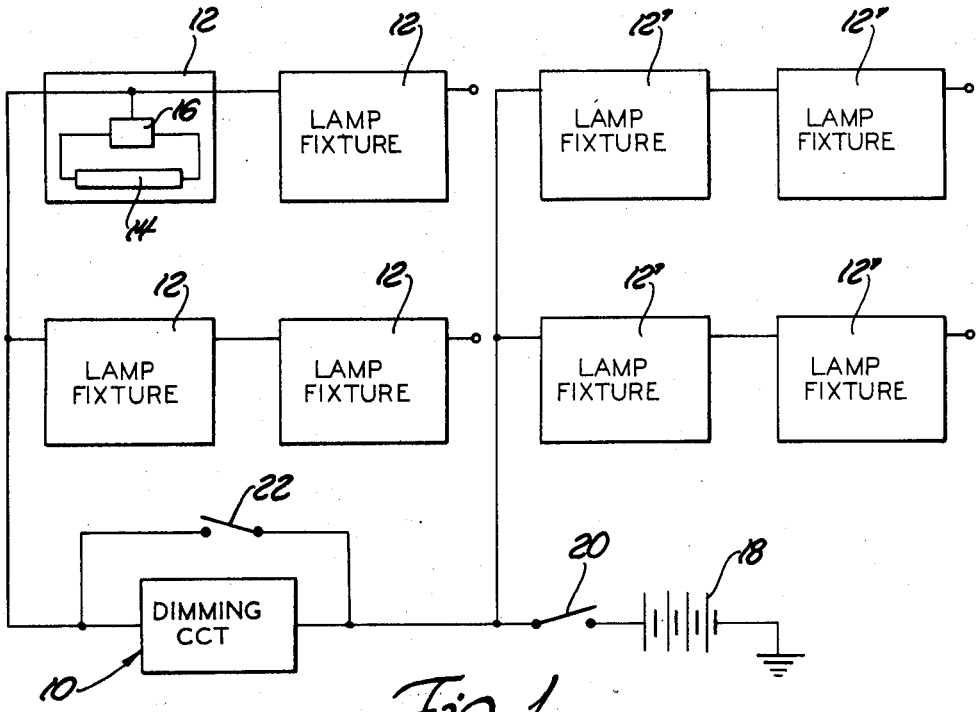
FIG. 1 is a diagram of a fluorescent lighting system embodying the present invention.

Referring now to the drawings, an illustrative embodiment of the invention is shown for intensity control or dimming of fluorescent lamps in a DC lighting circuit. The illustrative embodiment is especially adapted for use in lighting systems for buses. However, it will be appreciated, as the description proceeds, that the invention is applicable to a wide variety of uses for dimming fluorescent lamps.

FIG. 1 is a diagram of a fluorescent lighting system which is provided with the dimmer circuit 10 of this invention. The lighting system comprises a plurality of fluorescent lamp fixtures 12 in one group and a plurality of fixtures 12' in another group all of which are identical to each other. Each lighting fixture comprises a fluorescent lamp 14 and an inverter 16. The fluorescent fixtures 12 are energized from a battery 18 through an on/off switch 20 and the dimming circuit 10. The dimming circuit 10 is provided with a bypass switch 22 which is connected in shunt with the dimming circuit. The fluorescent fixtures 12' are energized from the battery 18 through the on/off switch 20 but are not connected through the dimming circuit 10. The lighting circuit is typical of a bus lighting system in which the dimming circuit 10 has been installed. The fluorescent fixtures 12 are those at the front of the bus which illuminate a portion of the passenger area and which, at full intensity, may interfere with the bus driver's ability to see the roadway. The fixtures 12' are those at the rear of the bus which illuminate the remaining portion of the passenger area. The dimming circuit 10 is selectively operated by the bus driver as needed. For example, at a bus stop in an area of low ambient light level the driver may wish to dim the front lighting of the bus to reduce reflection from the windshield. This is done by opening the override switch 20 which allows the dimming circuit to become operative and reduce the intensity of the lamps 14 in the fixtures 12 to a preset level of intensity. When the override switch 20 is closed the dimming circuit is effectively removed from the system and the lamps of fixtures 12 operate at full rate intensity.

Figure 2:
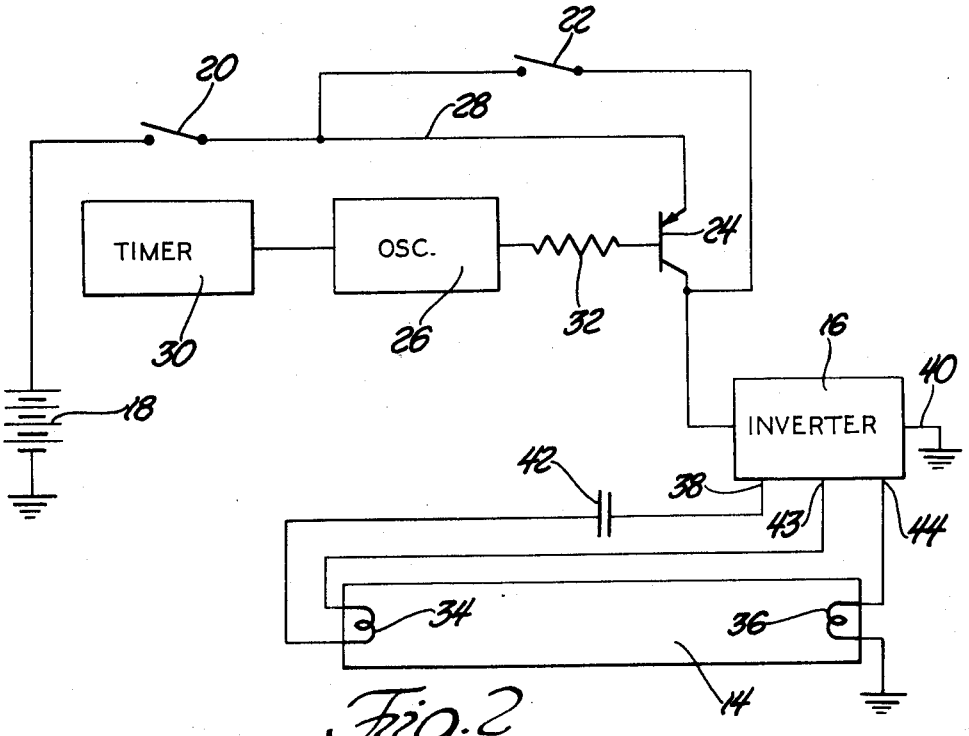
FIG. 2 is a block diagram of the fluorescent lamp dimming means of this invention.

The dimming circuit is shown in block diagram in FIG. 2. The dimming circuit comprises means for inhibiting the operation of the inverter 16 so that the output thereof is interrupted periodically for controlled time intervals. The inhibiting means comprises an electronic switch, in the form of a transistor 24, and an oscillator 26 which controls the switch. The inverter 16 receives its power supply from the battery 18 through the on/off switch 20 and a power supply conductor 28. The dimming circuit 10 also comprises a timer 30 which provides a time delay in the starting of the oscillator 26 after the on/off switch 20 is closed. The oscillator 26 is connected through a resistor 32 to the input of the transistor 24 and operates to switch the transistor 24 on and off at the frequency of the oscillator 26. Accordingly the power supply to the inverter 16 is interrupted periodically by the switching of transistor 24. Thus, when the oscillator 26 is not running the inverter 16 is supplied with uninterrupted supply voltage and the inverter produces an uninterrupted train of DC pulses. The output of the inverter is applied to the fluorescent lamp 14. The lamp 14 is of conventional structure and includes a pair of electrodes 34 and 36. The high voltage output from the inverter 16 is produced between a high voltage terminal 38 and a ground terminal 40. The high voltage terminal 38 is connected through a ballast capacitor 42 to the electrode 34. (The ballast capacitor 42 is usually supplied as an integral part of a fluorescent lamp inverter.) The electrode 36 is connected to ground and hence the high voltage output of the inverter is applied across the electrodes of the fluorescent lamp. In a conventional manner, the electrodes 34 and 36 are supplied with heating current from low voltage supply terminals 43 and 44, respectively, on the inverter.

Figure 3:
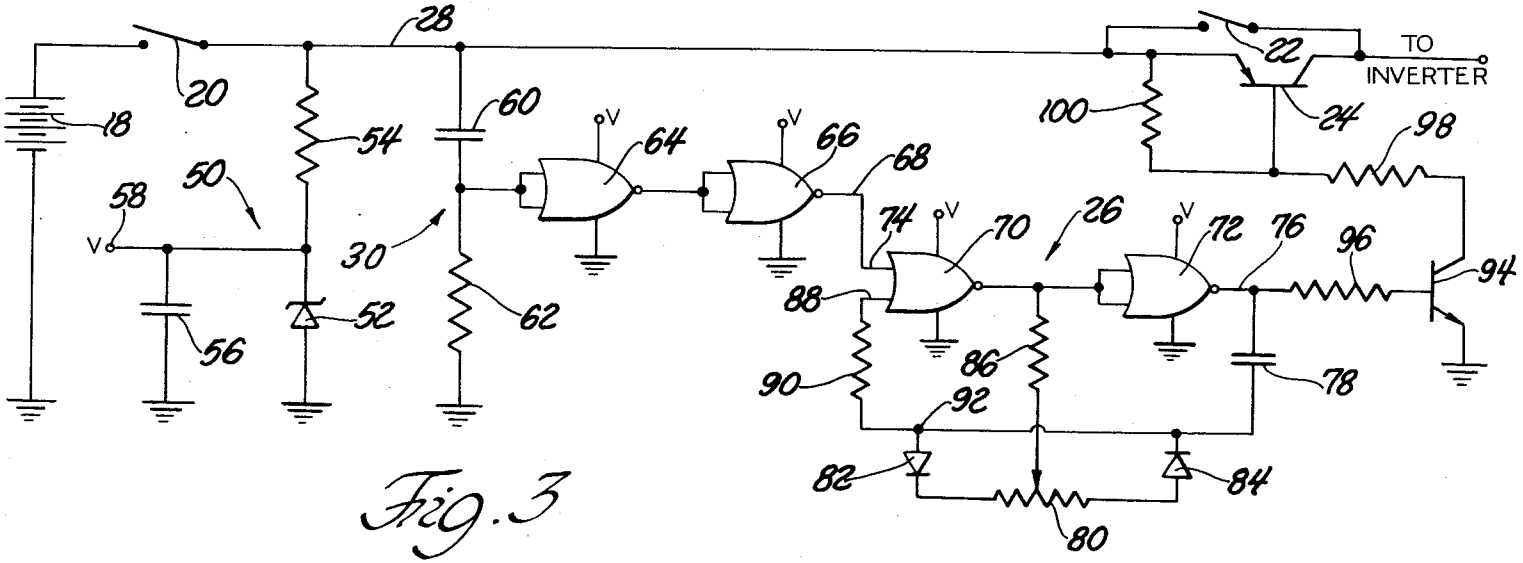
FIG. 3 is a schematic diagram of the dimming circuit of this invention.

The dimming circuit is shown in schematic diagram in FIG. 3. This circuit is implemented in part by use of CMOS integrated circuits for the timer 30 and the oscillator 26. A voltage regulator 50 is provided to supply the integrated circuits with a constant voltage V. The regulator circuit 50 comprises a Zener diode 52 connected in series with a resistor 54 across the supply voltage line 28. A capacitor 56 is connected in parallel with the Zener diode and regulated voltage V is provided at a terminal 58.

The timer 30 comprises a time constant circuit including a series capacitor 60 and a resistor 62 connected in series across the supply voltage line 28. The timer also comprises a pair of inverters (logic gates) 64 and 66. (Each inverter is provided by a NOR gate with the input pins tied together.) The input port of inverter 64 is connected with the junction of capacitor 60 and resistor 62 and the output port of inverter 64 is connected to the input port of the inverter 66. The output of the timer is taken at the output port 68 of the inverter 66. The timer is operative to provide a logic one or high output voltage for a predetermined time delay after the on/off switch 20 is closed. At the end of the time delay period the output of the timer switches to a logic zero or low output voltage. The operation of the timer 30 is as follows. When the on/off switch 20 is closed the capacitor 60 starts to charge through the resistor 62. Initially the voltage across resistor 62 is relatively high and this voltage is applied to the input of the inverter 64. Accordingly the initial output of the inverter 64 is low and this causes the initial output of the inverter 66 to be high. At a predetermined time delay after the closure of switch 20, the capacitor 60 will be charged sufficiently so that the voltage across resistor 62 is reduced to a logic low. This causes the output of the inverter 64 to go high which, in turn, causes the output of inverter 66 to go low. Preferably, the time delay period of the timer 30 is set at about 30 to 60 seconds for reasons to be discussed below. The time delay value is, of course, set by the values of the capacitor 60 and the resistor 62. The output port 68 of the timer 30 is connected to the oscillator 26.

The oscillator 26 includes a NOR gate 70 and an inverter 72 (a NOR gate with input pins tied together). The output port 68 of the timer is connected with an input port 74 of the NOR gate 70 and the output port of the NOR gate 70 is connected to the input port of the inverter 72. The output port 76 of the inverter 72 is connected to one terminal of a capacitor 78 which has its other terminal connected to opposite end terminals of a potentiometer 80 through a charging circuit diode 82 and a discharging circuit diode 84, respectively. The potentiometer 80 has a movable tap which is connected through a resistor 86 to the output port of the NOR gate 70. The other input port 88 of the NOR gate 70 is connected through a resistor 90 to a node 92 between the capacitor 78 and the diodes 82 and 84.

The oscillator 26 operates in the following manner. When the voltage on input port 74 of NOR gate 70 is high, the output is low and accordingly the output of the inverter 72 is high. Thus, during the time delay period of the timer 30 the output of the oscillator at the output port 76 is high. Capacitor 78 is charged through a charging circuit which extends through the charging diode 82, potentiometer 80 and resistor 86 to the output port of the NOR gate 70. In this condition, the voltage at the input port 88 of the NOR gate 70 is low. After the time delay period of timer 30, the voltage at the input port 74 of NOR gate 70 goes low and the output of the NOR gate 70 goes high. This causes the output of the inverter 72 to go low and the capacitor 78 is discharged through a discharge circuit extending through the resistor 86, potentiometer 80 and discharging diode 84. This causes the input port 88 of the NOR gate 70 to go high and hence the output thereof goes low. This causes the output of the inverter 72 to go high and the capacitor 78 is charged through the charging circuit. This causes the input port 88 of NOR gate 70 to go low and the output port 70 to go high. The cycle just described is repeated over and over and the oscillator 26 produces a train of positive pulses at the output port 76. The pulse repetition rate, or frequency, of the oscillator 26 is determined by the time constants of the charging and discharging circuits of the capacitor 78. Preferably, the frequency of the oscillator 26 is substantially lower, say by a factor of about 10, than the frequency of the inverter 16. The pulse duration of the positive pulses produced by the oscillator 26 is determined by the relationship of the time constants of the charging and discharging circuits of the capacitor 78. Preferably, the pulse duration is several times larger, say by a factor of two to five, than the pulse duration of the output pulses of the inverter 16. The pulse duration of the output pulses of the oscillator 26 may be adjusted by the potentiometer 80.

As stated above, the output of the oscillator 26 is utilized to control the switching transistor 24 and hence the on/off time of the inverter 16. For this purpose, a driver transistor 94 is connected between the output of the oscillator 26 and the input of the switching transistor 24. In particular, the output port 76 of the inverter 72 is connected through a resistor 96 to the base of the driver transistor 94. The transistor 94 has its emitter connected to ground and its collector is connected through a resistor 98 and a resistor 100 to the supply voltage line 28. The junction of the resistors 98 and 100 is connected to the base of transistor 24 which has its emitter connected with the supply voltage line 28 and its collector connected to the power input terminal of the inverter 16. Thus, when the output of the oscillator 26 at the output port 76 is high, the driver transistor 94 is turned on and the switching transistor 24 is also turned on. When the output of the oscillator 26 is low the driver transistor and the switching transistor are both turned off.

An exemplary embodiment of the circuit of FIG. 3 has been constructed using a two-input quad NOR CMOS integrated circuit chip, type CD4001, manufactured by RCA Corporation. The four NOR gates of the chip are utilized for the inverters 64, 66 and 72 and the NOR gate 70. The inverter 16 is a fluorescent lamp ballast inverter manufactured by Swiss Controls, Incorporated and designated as Model 1903. The circuit was built with the following component values:

| | |
|---|---|
| Capacitor 60 | 4 mmf |
| Resistor 62 | 1 meg |

-continued

| | |
|---|---|
| Resistor 90 | 680 k |
| Resistor 86 | 1k |
| Pot 80 | 100 k |
| Capacitor 78 | 0.022 mf |

Figure 4:
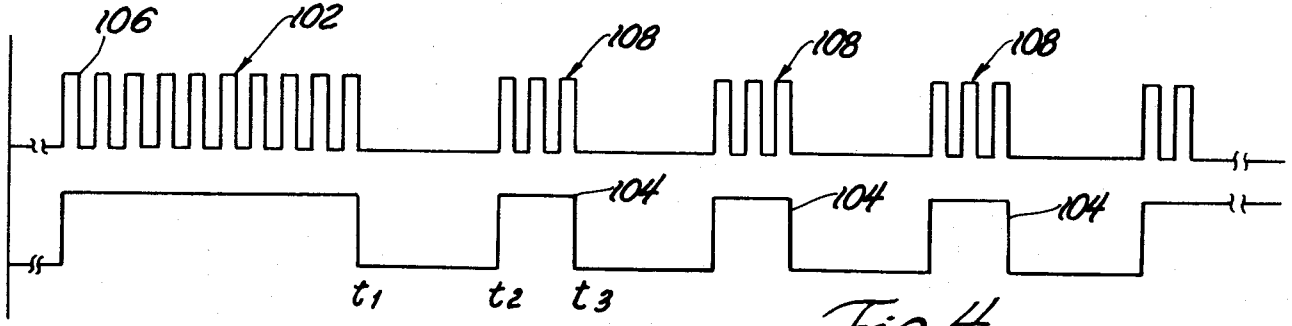
FIG. 4 is a timing diagram to aid explanation of the operation of the inventions.

The operation of the dimmer circuit will be described with reference to FIGS. 3 and 4. When the on/off switch 20 is closed to turn on the fluorescent lamp; the switching transistor 24 will be in an on state, i.e. a closed switched condition, and the supply voltage from the battery 18 will be applied to the inverter 16. Accordingly the inverter 16 will produce a continuous and uninterrupted train 102 of output pulses 106 which are effective to start and run the associated fluorescent lamp at its full rated intensity. Also, when the on/off switch 20 is closed, the timer 30 commences timing and after the preset time delay thereof the output at port 68 goes low. This change of input voltage to the oscillator 26 causes the oscillator to start running and the output thereof goes low at time t1 and remains low until time t2. Then at t2 the oscillator output goes high and remains high until it goes low at t3, which completes one cycle of the oscillator. Thus, the oscillator produces a train of positive pulses 104 having a pulse duration of t3-t2. When the output of the oscillator 26 is low the driver transistor 94 is turned off and the switching transistor 24 is turned off; accordingly the output of the inverter 16 is inhibited, i.e. the inverter is off. When the output of the oscillator 26 is high the driver transistor 94 and the switching transistor 24 are turned on and the inverter 16 is turned on and thus produces inverter pulses 106 for the duration of the oscillator pulses 104. Thus, as long as the oscillator 26 is running, the inverter produces intermittent bursts 108 of pulses 106. This has the effect of reducing the current on-time in the fluorescent lamp and hence the time average value of lamp current, with the result of reducing the intensity of the lamp. However, the peak voltage applied to the electrodes of the lamp remains the same during the operation at reduced intensity as that during operation at full intensity. This results in stable operation of the lamp without noticable flicker or other disturbances when the lamp is operated at the low intensity. Further, it is believed that the operation at reduced intensity in this manner does not have any significant adverse effect on lamp lite or lamp performance.

Full intensity operation of the lamps may be restored at any time by closing the override switch 22. This switch, in the closed position, bypasses the dimming circuit so that the inverter 16 receives uninterrupted supply voltage from the battery 18 and produces an uninterrupted train of inverter pulses.

Although the description of this invention has been given with reference to a particular embodiment, it is not to be construed in a limiting sense. Many variations and modifications will now occur to those skilled in the art. For a definition of the invention, reference is made to the appended claims.

What is claimed is:

1. The method of dimming a fluorescent lamp comprising the steps of, producing a first pulse train of voltage pulses of substantially constant amplitude having a repetition rate and pulse duration such that the pulse train has a first predetermined average value of on-time over a time interval which includes a plurality of the DC voltage pulses, applying said first pulse train with uniform polarity across the lamp, said constant amplitude and said first predetermined average value of on-time being sufficient to start said lamp and to run said lamp at a given intensity, changing said first pulse train to a second pulse train of DC voltage pulses having an amplitude the same as said substantially constant amplitude but having a second predetermined average value of on-time over a time interval which includes a plurality of the DC voltage pulses of the second pulse train, said second predetermined average value of on-time being less than the first predetermined average value of on-time but sufficient to run said lamp at an intensity less than said given intensity to thereby dim said lamp.

2. The invention as defined in claim 1 wherein the step of changing said first pulse train is accomplished by periodically interrupting said first pulse train so that there are plural pulses in said second DC pulse train between each interruption and the average value of on-time is thereby reduced.

3. For use in controlling the intensity of a fluorescent lamp, said lamp being connected in a circuit of the type including an inverter having output terminals connected across the lamp and having input terminals adapted to be connected with a DC voltage source, said inverter being adapted to produce a train of voltage pulses having a sufficient amplitude to start said lamp and to run said lamp at a given intensity, the improvement for reducing said intensity comprising an electronic switch connected with said inverter for inhibiting the output of said inverter when the electronic switch is actuated, and an oscillator connected with the electronic switch for periodic actuation thereof, each actuation being for a time duration small enough to maintain said lamp ionized whereby the intensity of said lamp is reduced.

4. The invention as defined in claim 3 wherein said oscillator includes means for adjusting the frequency thereof.

5. The invention as defined in claim 4 wherein the pulse duration of said oscillator is at least several times greater than the pulse duration of said inverter.

6. The invention as defined in claim 3 including an on/off switch connected between said voltage source and said electronic switch, and timing means connected between said on/off switch and said oscillator for disabling said oscillator for a predetermined time interval after closure of said on/off switch.

7. The invention as defined in claim 3 including a manually actuable bypass switch connected in shunt with said electronic switch whereby said electronic switch is rendered ineffective by closing the bypass switch.

* * * * *